US012352256B1

(12) United States Patent
Chen

(10) Patent No.: US 12,352,256 B1
(45) Date of Patent: Jul. 8, 2025

(54) ENCLOSED AIR COMPRESSOR STRUCTURE FEATURING REMOTE FILTERING

(71) Applicant: DONGGUAN HESHENG MACHINERY & ELECTRIC CO., LTD., Dongguan (CN)

(72) Inventor: Chi-Wen Chen, New Taipei (TW)

(73) Assignee: DONGGUAN HESHENG MACHINERY & ELECTRIC CO., LTD., Dongguan (CN)

( * ) Notice: Subject to any disclaimer, the term of this patent is extended or adjusted under 35 U.S.C. 154(b) by 0 days.

(21) Appl. No.: 18/673,361

(22) Filed: May 24, 2024

(51) Int. Cl.
*F04B 39/06* (2006.01)
*F04B 35/06* (2006.01)
*F04B 39/16* (2006.01)

(52) U.S. Cl.
CPC ..... *F04B 39/16* (2013.01); *F04B 35/06* (2013.01); *F04B 39/066* (2013.01)

(58) Field of Classification Search
CPC ..... F04B 39/16; F04B 39/066; F04B 39/12; F04B 39/121; F04B 35/06; B01D 46/0002; B01D 46/0005; B01D 46/10; B01D 46/42; B01D 46/429; B01D 46/44; B60C 29/00; B60C 23/00; B60C 23/001
See application file for complete search history.

(56) References Cited

U.S. PATENT DOCUMENTS 7,001,156 B2 * 2/2006 Chen ..... F04B 39/066 55/467
7,322,801 B2 * 1/2008 Li ..... A47C 27/10 417/442
11,465,541 B2 * 10/2022 Sakai ..... F04B 35/04
2012/0118412 A1 * 5/2012 Barry ..... G05D 9/12 73/304 C
2015/0147208 A1 * 5/2015 Chen ..... F04B 39/0094 417/423.8

* cited by examiner

*Primary Examiner* — Dapinder Singh
(74) *Attorney, Agent, or Firm* — Leong C. Lei

(57) ABSTRACT

An enclosed air compressor structure featuring remote filtering includes a carrying receptacle, an air compressor assembly, and a cover plate. The carrying receptacle and the cover plate are combinable to have the air compressor assembly arranged, in a concealed manner, in the interior of the carrying receptacle. The air compressor assembly has an inlet end that is connected with a first guide tube and is connected to and in communication with a filter assembly and an outlet end that is connected with a second guide tube and is connected to and in communication with an exhaust valve, so that external air moves through the filter assembly and the first guide tube to get into the air compressor assembly, and compressed air is discharged through the second guide tube and the exhaust valve. The externally mounted filter assembly filters off powdery dust, sand/gravel, and moisture contained in air.

8 Claims, 6 Drawing Sheets

ENCLOSED AIR COMPRESSOR STRUCTURE FEATURING REMOTE FILTERING

BACKGROUND OF THE INVENTION

(a) Technical Field of the Invention

The present invention relates to an enclosed air compressor structure featuring remote filtering, and more particularly to an air compressor assembly that is connected with an externally mounted filter assembly to effectively prevent powdery dust, sand/gravel, and moisture in an operation environment from entering the interior of the air compressor assembly to cause damage and corrosion to a drive motor and a cylinder block, so as to achieve effective increase of the service life of the air compressor assembly and also to make the air compressor assembly applicable to various severe environments.

(b) Description of the Prior Art

An air compressor or an inflator machine is primarily used as a source for charging air to a pneumatic tool, a vehicle tire, or various inflatable objects. In the field of do-it-yourselves (DIY), the air compressor or inflator machine, besides playing a role as a necessary tool in a workshop or for general home improvements, are also a must for backup emergency air charging for vehicle tires.

The operation principle of the air compressor or inflator machine is, primarily, an internally arranged electric machine directly driving a crankshaft to cause a rotation motion of the crankshaft in order to drive a link to make a piston reciprocally moving up and down to cause a change of the cylinder block volume to fulfill compression and exhaust of a compressible gas to thereby complete a process of air compression. As such, in the entire process of intake, compression, and exhaust, due to the change of the cylinder block volume, the compressed air moves through a one-way valve mechanism (check valve) to allow the compressible gas to conduct through a flexible tube to discharge through a nozzle, so as to charge the gas into an object.

However, in the field of application of known medium-or small-sized air compressors or inflator machines for tire inflation purposes, there is generally no filter device provided for filtering off powdery dust, sand/gravel, and moisture. Thus, in a severe environment, there is often excessively high powdery dust, sand/gravel, and moisture, which causes severe influence on the air compressor or inflator machine. Once the powdery dust, sand/gravel, and moisture gets into the interior of the inflator machine or the air compressor assembly, the first situation is damage of motor, and the cylinder block is also affected by the powdery dust, sand/gravel, and moisture to cause fast abrasion between the piston inside the cylinder wall. Further, moisture of a high humidity, if getting into the device interior of the air compressor or the inflator machine, may cause corrosion of the motor, the piston, and the cylinder, resulting in significant reduction of service life of the air compressor or inflator machine.

Thus, the primary issue that the present invention aims to resolve is to provide an air compressor or inflator machine that is capable of filtering off powdery dust, sand/gravel, and moisture contained in an external environment in order to increase the service life of the entirety of the air compressor or inflator machine.

SUMMARY OF THE INVENTION

The primary objective of the present invention is to provide an enclosed air compressor structure featuring remote filtering, which comprises a carrying receptacle, an air compressor assembly, and a cover plate. The carrying receptacle forms a receiving space in an interior thereof, and the carrying receptacle is provided with a ventilation grating sheet arranged on at least one sidewall thereof, so that external air is movable through the ventilation grating sheet to get into the receiving space. The air compressor assembly is placed in the receiving space of the carrying receptacle and has at least one inlet end and at least one outlet end. The inlet end is connected with a first guide tube and is connected to and in communication with a filter assembly, so that the filter assembly is connected externally to the air compressor assembly and is located in the receiving space of the carrying receptacle. The outlet end is connected with a second guide tube and is connected to and in communication with an exhaust valve, so that the exhaust valve is connected externally to the air compressor assembly and extends out of the receiving space of the carrying receptacle. The cover plate is connected to a top portion of the carrying receptacle and closes the receiving space. The cover plate is formed with at least one opening, and the exhaust valve is exposed outside of the opening.

As such, when the air compressor assembly is activated, external air is forcibly drawn in through the filter assembly to realize a function of forced intake, meaning moving sequentially through the filter assembly and the first guide tube to get into the air compressor assembly, and the air compressor assembly then supplies air compressed thereby sequentially through the second guide tube and the exhaust valve to discharge to complete the entire process of intake, compression, and exhaust.

The primary technical feature of the present invention is that the air compressor assembly is connected with an externally mounted filter assembly, and the externally mounted filter assembly may effectively filter off powdery dust, sand/gravel, and moisture entraining air to effectively prevent the effectively filter off powdery dust, sand/gravel, and moisture entraining air from getting into the interior of the air compressor assembly to cause a series of damage and corrosion to the motor and the cylinder block, thereby effectively increasing the service life of the air compressor and allowing the air compressor to be used in various severe environments (such as the air compressor being used in environments of beaches and seashores).

Further, the carrying receptacle may receive the air compressor assembly and the filter assembly to place therein and the cover plate may close the receiving space to have the air compressor assembly and the filter assembly completely concealed in the carrying receptacle, preventing the air compressor assembly and the filter assembly from exposure to sunlight and rains to thereby further enhance the life span of the air compressor and to make the air compressor applicable to various environments.

DETAILED DESCRIPTION OF THE PREFERRED EMBODIMENTS

Figure 1:
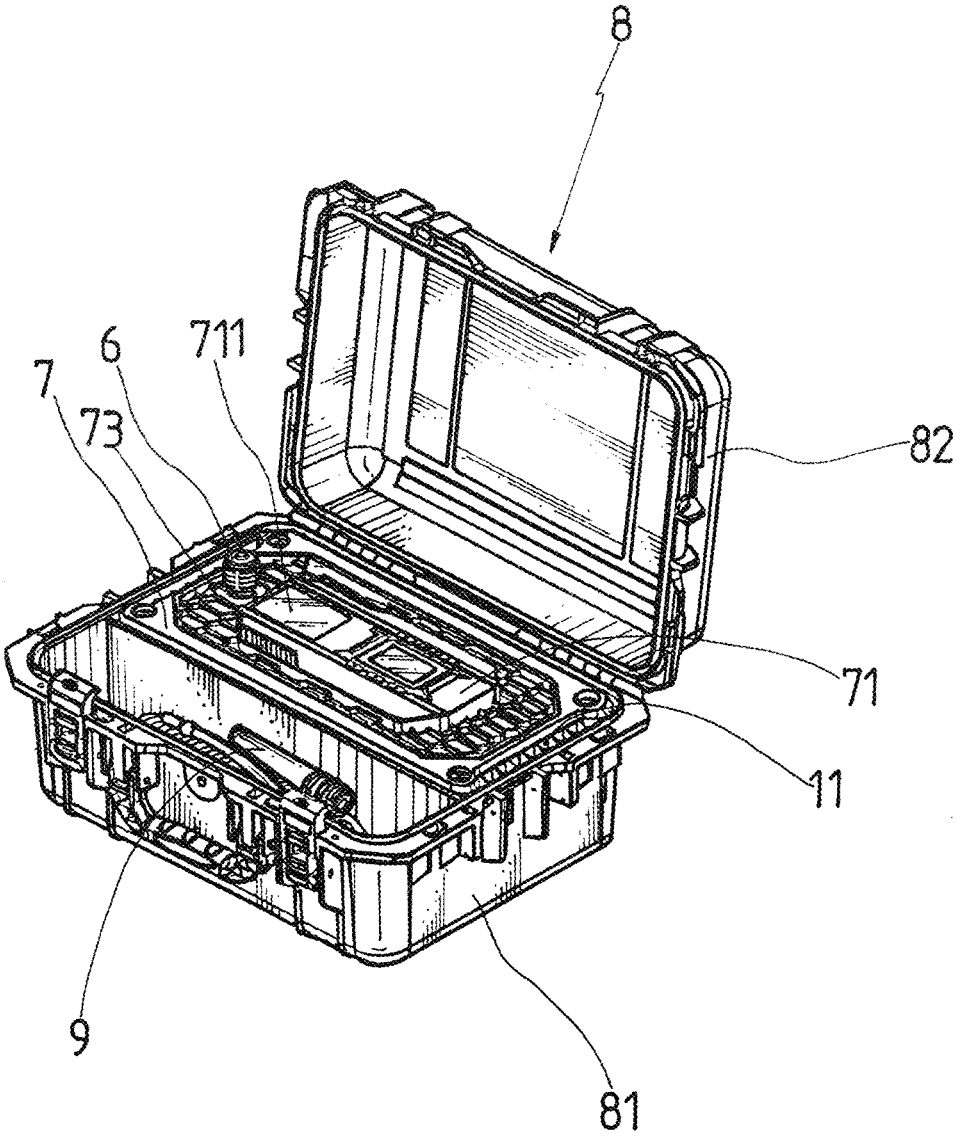
FIG. 1 is a perspective view showing an enclosed air compressor structure featuring remote filtering according to an embodiment of the present invention.
Figure 2:
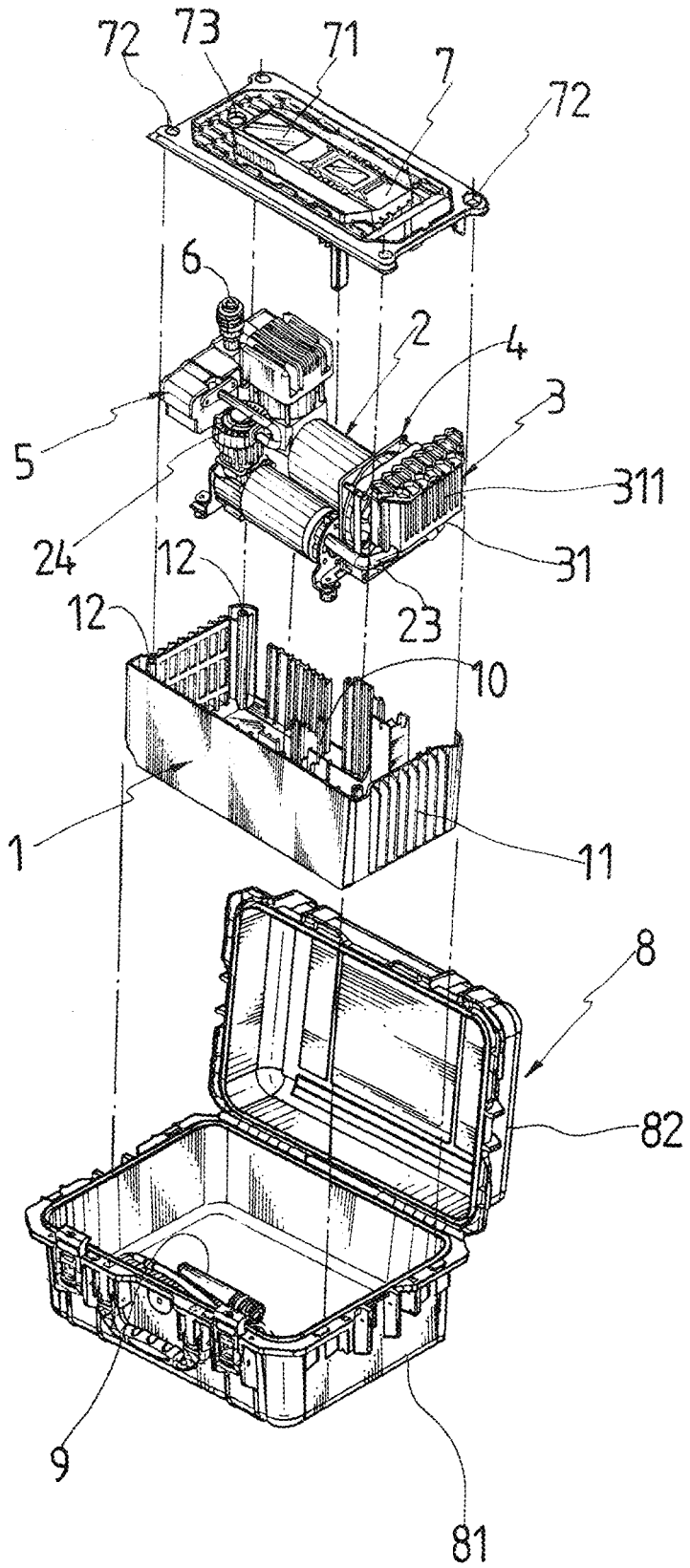
FIG. 2 is an exploded view showing the enclosed air compressor structure featuring remote filtering according to an embodiment of the present invention.
Figure 3:
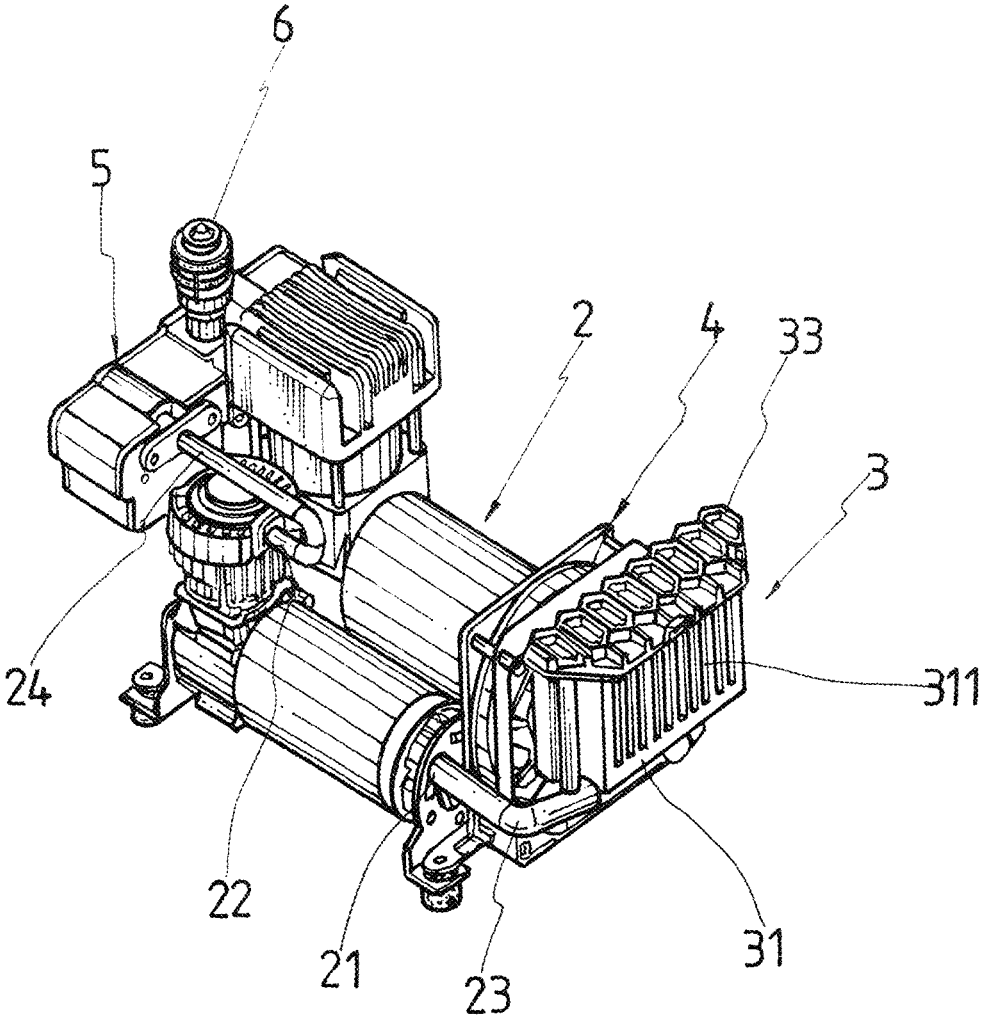
FIG. 3 is a perspective view showing an air compressor assembly of the enclosed air compressor structure featuring remote filtering according to the present invention.
Figure 4:
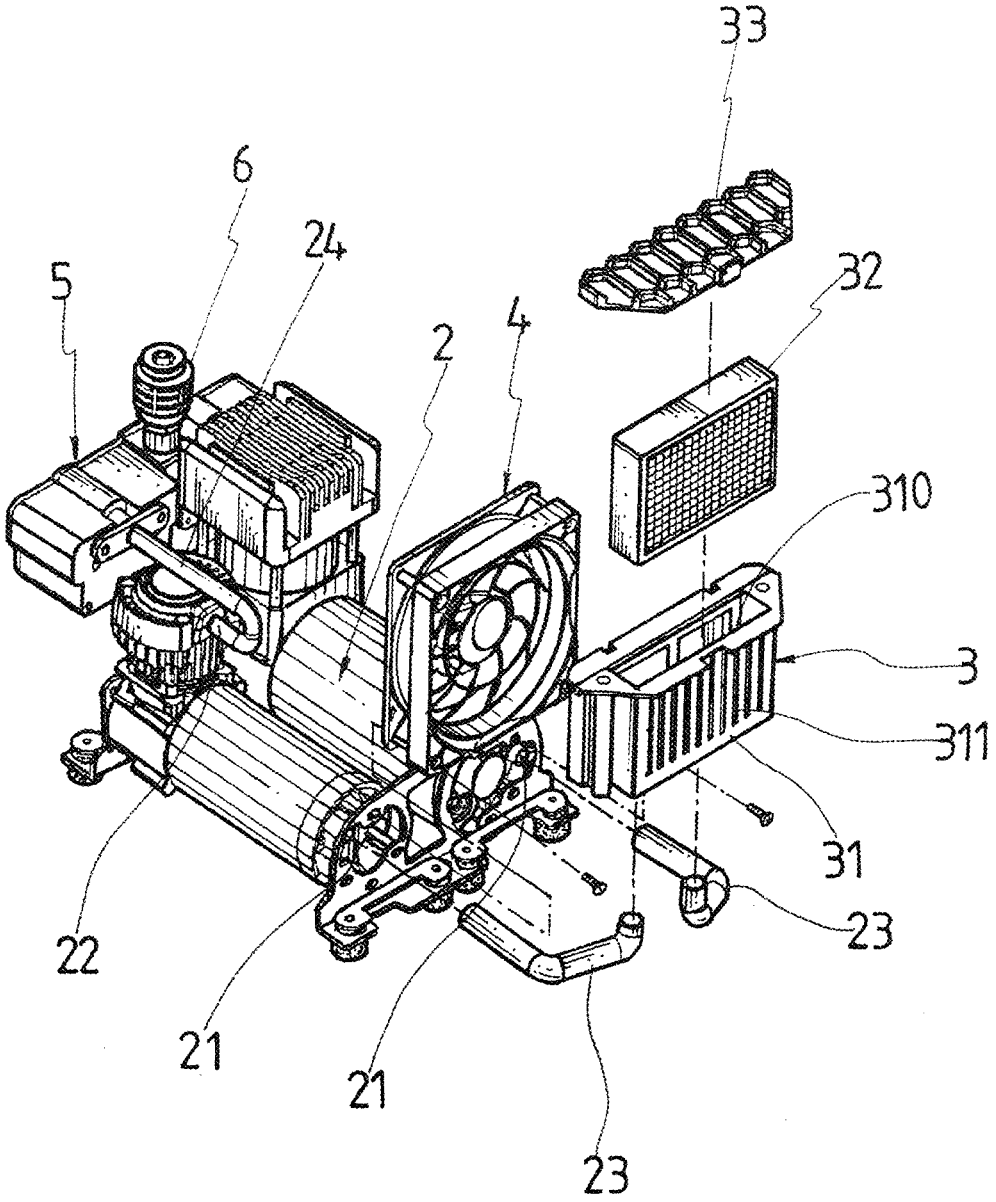
FIG. 4 is a partial exploded view showing the air compressor assembly of the r enclosed air compressor structure featuring remote filtering according to the present invention.
Figure 5:
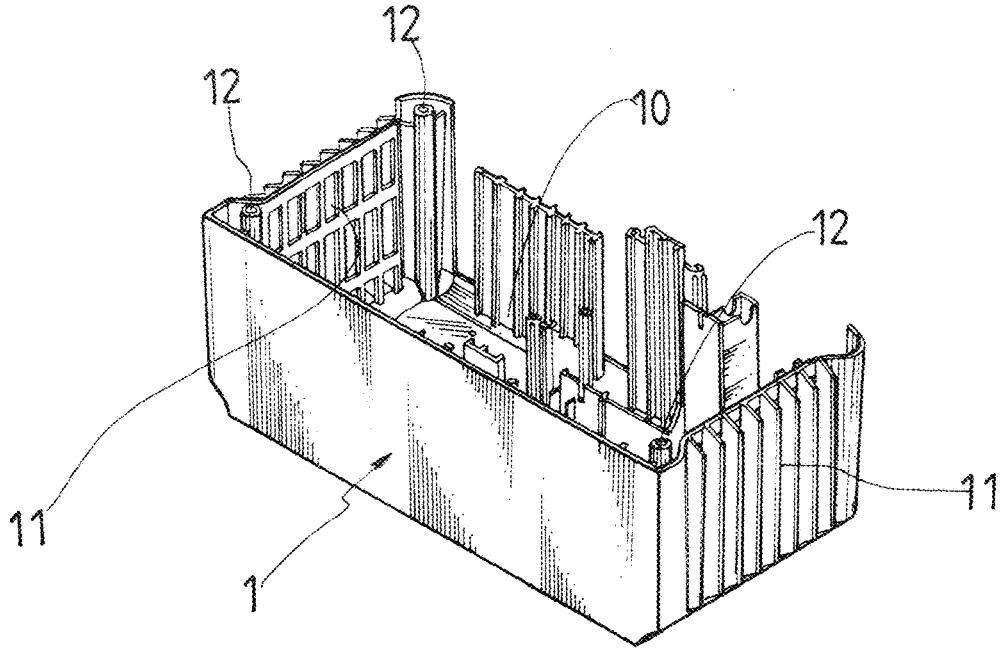
FIG. 5 is a schematic view showing a carrying receptacle of the enclosed air compressor structure featuring remote filtering according to the present invention.
Figure 6:
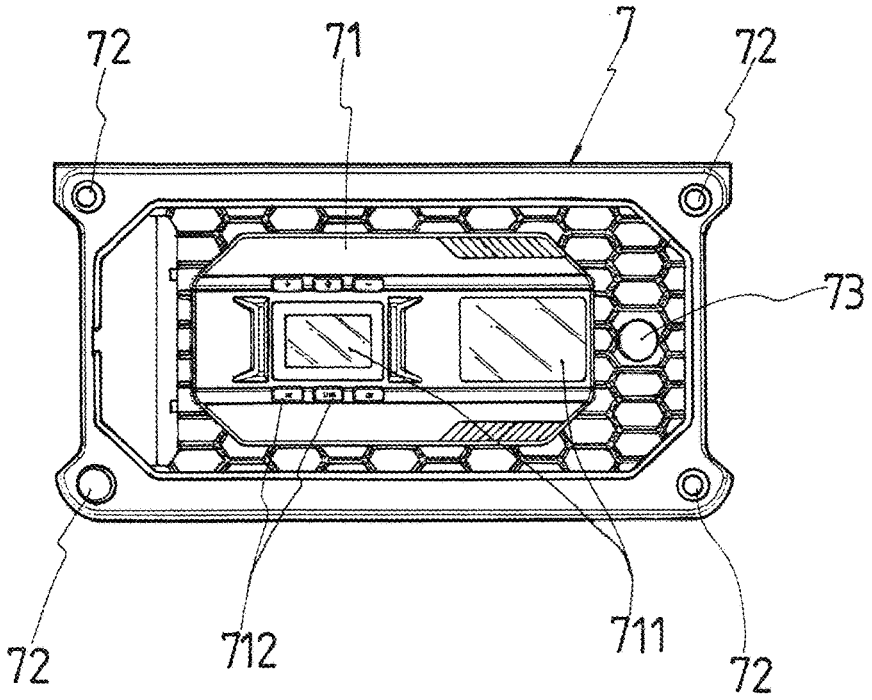
FIG. 6 is a schematic view showing a cover plate of the enclosed air compressor structure featuring remote filtering according to the present invention.

Referring to FIGS. 1-7, the present invention provided an enclosed air compressor structure featuring remote filtering, which comprises a carrying receptacle 1, an air compressor assembly 2, and a cover plate 7.

The carrying receptacle 1 forms a receiving space 10 in an interior thereof. The carrying receptacle 1 is provided with a ventilation grating sheet 11 arranged on at least one or more than one sidewall thereof. The ventilation grating sheet 11 is formed with a plurality of ventilation openings, so that external air is allowed to move through the ventilation grating sheet 11 to get into the receiving space 10. The carrying receptacle 1 is formed, in a periphery of a top portion thereof, with a plurality of first fastening holes 12.

The air compressor assembly 2 is arranged in the receiving space 10 of the carrying receptacle 1. The air compressor assembly 2 comprises at least one inlet end 21 and at least one outlet end 22. The air compressor assembly 2 comprises a drive motor, a gear set, at least one or more than one cylinder, a link, and a piston; however, assembling of the drive motor, the gear set, the cylinder, the link and the piston of the air compressor assembly 2 is not a novel part of the present invention and no further description will be provided herein.

The air compressor assembly 2 may include multiple cylinders, each of which has an inlet end 21. For example, the air compressor assembly 2 of the present invention may include two cylinders, and the air compressor assembly 2 of the present invention comprises two inlet ends 21. The inlet end 21 of the air compressor assembly 2 is connected with a first guide tube 23 and is connected to and in communication with a filter assembly 3, so that the filter assembly 3 is connected externally to the air compressor assembly 2 and is located in the receiving space 10. The outlet end 22 of the air compressor assembly 2 is connected with a second guide tube 24 and is connected to and in communication with an exhaust valve 6, so that the exhaust valve 6 is connected externally to the air compressor assembly 2 and extends to outside of the receiving space 10.

Figure 7:
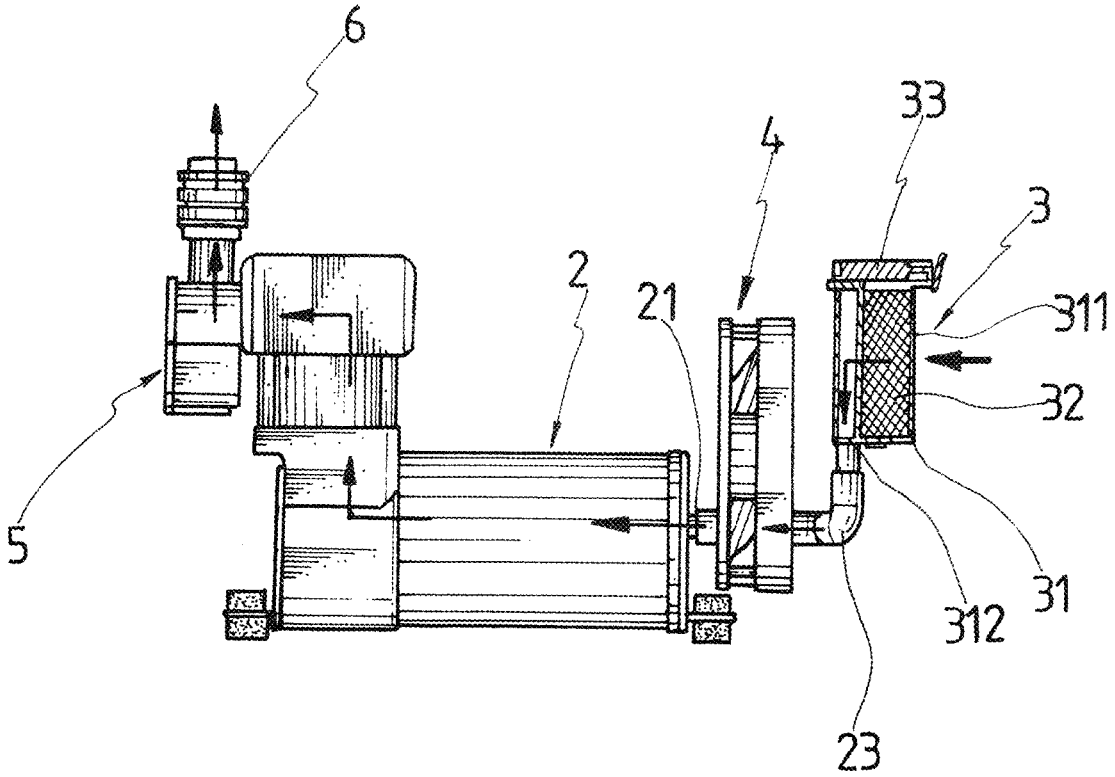
FIG. 7 is a schematic view showing an air flowing direction of the enclosed air compressor structure featuring remote filtering according to the present invention.

The filter assembly 3 comprises a housing 31, a filtering material 32, and a top cap 33. The housing 31 defines, in an interior thereof, a filtering space 310 in which the filtering material 32 is disposed. One side of the housing 31 that corresponds to the filtering material 32 is formed with a plurality of ingress openings 311, and another side of the housing 31 that corresponds to the filtering material 32 is formed with an egress opening 312 (as shown in FIG. 7). The housing 31 is combined, at a top portion thereof, with the top cap 33, and the top cap 33 hermetically closes and seals the filtering space 310. The first guide tube 23 of the air compressor assembly 2 is connected to the egress opening 312 of the filter assembly 3, so that the inlet end 21 of the air compressor assembly 2 and the filter assembly 3 are connected by the first guide tube 23.

The air compressor assembly 2 is provided, at an outside thereof corresponding to the inlet end 21, with at least one fan 4, and the fan 4 blows external cold air toward the entirety of the air compressor assembly 2 to implement a cooling effect on the entirety of the air compressor assembly 2.

An air accumulation tank 5 is further arranged between the second guide tube 24 of the air compressor assembly 2 and the exhaust valve 6. In other words, the second guide tube 24 is connected to an inlet opening of the air accumulation tank 5, and the exhaust valve 6 is connected to an outlet opening of the air accumulation tank 5, so that compressed air supplied through the second guide tube 24 of the air compressor assembly 2 is first accumulated in the air accumulation tank 5 to allow the compressed air to be subsequently exhausted through the exhaust valve 6.

The cover plate 7 is connected to a top portion of the carrying receptacle 1 to close the receiving space 10. The cover plate 7 is formed, in a periphery thereof, with a plurality of second fastening holes 72. The second fastening holes 72 correspond to the first fastening holes 12 of the carrying receptacle 1, and screws that are externally provided may respectively penetrate through and fasten to the first fastening holes 12 and the second fastening holes 72, so as to have the cover plate 7 securely connected to the top portion of the carrying receptacle 1. Further, the cover plate 7 is provided, on a surface thereof, with a control module 71. The control module 71 comprises at least one display panel 711 and a plurality of control buttons 712. The control module 71 is separately and electrically connected to the air compressor assembly 2 (specifically the drive motor of the air compressor assembly 2) and the fan 4. The control module 71 has a pre-set power wire that is connectable to a power supply terminal, and the control module 71 may supply electrical power to the air compressor assembly 2 and the fan 4, so as to control activation and deactivation of the air compressor assembly 2 and the fan 4. Further, the cover plate 7 is formed with at least one opening 73, and the exhaust valve 6 protrudes through the opening 73 to expose to the outside.

In summary, in an illustrative way of implementation of the present invention, the air compressor assembly 2, the filter assembly 3, the fan 4, and the air accumulation tank 5 are arranged in the receiving space 10 of the carrying receptacle 1, and the cover plate 7 is connected to the top portion of the carrying receptacle 1 to close the receiving space 10, so that the air compressor assembly 2, the filter assembly 3, the fan 4, and the air accumulation tank 5 are concealed in the interior of the carrying receptacle 1, and only the exhaust valve 6 is exposed outside of the opening 73 of the cover plate 7 (as shown in FIG. 1), and as such, the exhaust valve 6 provides connectability with an external inflation connection tube 9.

When the control module 71 controls the air compressor assembly 2 to activate (as shown in FIG. 7), external air is forcibly sucked in through the ingress openings 311 of the filter assembly 3, meaning the external air entering through the ingress openings 311 of the filter assembly 3, and is filtered by the filtering material 32, and then the air flows from the egress opening 312 of the filter assembly 3 toward the first guide tube 23 and the inlet end 21 to get into the cylinder of the air compressor assembly 2, and then, the air compressor assembly 2 supplies the air compressed thereby through the second guide tube 24 into the air accumulation tank 5, and finally, the compressed air is discharged and exhausted from the exhaust valve 6. As such, the filtering material 32 of the filter assembly 3 is provided for effectively filtering off powdery dust, sand/gravel, and moisture entrain air to prevent the powdery dust, sand/gravel, and moisture entraining air from getting into the cylinder block of the air compressor assembly 2 to cause abrasion and corrosion to the motor and the cylinder block. In another illustrative example of the present invention, the carrying receptacle 1 is placeable in a protective box 8. The protective box 8 comprises a first box body 81 and a second box body 82 that are movable relative to each other for opening and closing. The carrying receptacle 1 and the inflation connection tube 9 can be placed in the first box body 81, and then the second box body 82 is set on and covers the first box body 81 for closure, so as to provide a user with easiness of carrying and protecting the entire ty of the air compressor assembly 2.

Thus, the primary technical feature of the present invention is that the air compressor assembly 2 is connected with an externally mounted filter assembly 3, so that the externally mounted filter assembly 3 is operable to filter off the powdery dust, sand/gravel, and moisture contained in air to effectively prevent the powdery dust, sand/gravel, and moisture entraining air from getting into the interior of the air compressor assembly 2 to cause damage and corrosion to the motor or the cylinder block, thereby achieving effective increase the service life of the air compressor assembly, and allowing the air compressor assembly of the present invention to be used in various severe environments (such as the air compressor being used in environments of beaches and seashores). Further, the carrying receptacle 1 may receive the air compressor assembly 2, the filter assembly 3, the fan 4, and the air accumulation tank 5 to dispose therein and the cover plate 7 may be applied to close the receiving space 10, so as to provide the air compressor assembly 2, the filter assembly 3, the fan 4, and the air accumulation tank 5 with perfect protection for being concealed in the interior of the carrying receptacle 1, preventing the air compressor assembly 2, the filter assembly 3, the fan 4, and the air accumulation tank 5 from exposure to sunlight and rains to thereby further enhance the life span of the air compressor and to make the air compressor easy to carry and applicable to various environments.

I claim:

1. An enclosed air compressor structure featuring remote filtering, comprising:

a carrying receptacle, which forms a receiving space in an interior thereof, the carrying receptacle being provided with a ventilation grating sheet on at least one sidewall thereof, so that external air is movable through the ventilation grating sheet into the receiving space;

an air compressor assembly, which is arranged in the receiving space of the carrying receptacle, the air compressor assembly comprising at least one inlet end and at least one outlet end, the inlet end being connected with a first guide tube and being connected to and in communication with a filter assembly, so that the filter assembly is connected externally to the air compressor assembly and is located in the receiving space, the outlet end being connected with a second guide tube and being connected to and in communication with an exhaust valve, so that the exhaust valve is connected externally to the air compressor assembly and extends outside of the receiving space; and a cover plate, which is connected to a top portion of the carrying receptacle and closes the receiving space, the cover plate being formed with at least one opening, the exhaust valve being exposed outside of the opening;

wherein when the air compressor assembly is activated, external air moves sequentially through the filter assembly and the first guide tube to get into the air compressor assembly, and the air compressor assembly then supplies air compressed thereby sequentially through the second guide tube and the exhaust valve to discharge in order to implement an inflation operation.

2. The enclosed air compressor structure featuring remote filtering according to claim 1, wherein the filter assembly comprises a housing, a filtering material, and a top cap, the housing defining, in an interior thereof, a filtering space in which the filtering material is arranged, one side of the housing corresponding to the filtering material being formed with a plurality of ingress openings, another side of the housing corresponding to the filtering material being formed with an egress opening, the housing being connected, at a top portion thereof, with the top cap so that the top cap closes the filtering space, the first guide tube of the air compressor assembly being connected to the egress opening, so that the inlet end of the air compressor assembly and the filter assembly are connected by the first guide tube.

3. The enclosed air compressor structure featuring remote filtering according to claim 1, wherein an air accumulation tank is arranged between the second guide tube of the air compressor assembly and the exhaust valve, the second guide tube being connected to an inlet opening of the air accumulation tank, the exhaust valve being connected to an outlet opening of the air accumulation tank, so that compressed supplied through the second guide tube of the air compressor assembly is accumulated in the air accumulation tank, and the exhaust valve then exhausts the compressed air.

4. The enclosed air compressor structure featuring remote filtering according to claim 1, wherein the cover plate is provided, on a surface thereof, with a control module, the control module comprising at least one display panel and a plurality of control buttons, the control module being electrically connected with the air compressor assembly.

5. The enclosed air compressor structure featuring remote filtering according to claim 4, wherein the air compressor assembly is provided with at least one fan outside of the inlet end, the fan being electrically connected with the control module, the fan being operable to blow external cold air toward the air compressor assembly.

6. The enclosed air compressor structure featuring remote filtering according to claim 1, wherein the carrying receptacle is formed, in a periphery of a top portion thereof, with a plurality of first fastening holes, and the cover plate is formed, in a periphery thereof, with a plurality of second fastening holes, the second fastening holes corresponding to the first fastening holes, external screws being receivable through the first fastening holes and the second fastening holes.

7. The enclosed air compressor structure featuring remote filtering according to claim 1, wherein the carrying receptacle is placeable in a protective box, the protective box comprising a first box body and a second box body movable relative to each other for opening and closing, the carrying receptacle being placed in the first box body, the second box body being set on and covering the first box body for closure.

8. The enclosed air compressor structure featuring remote filtering according to claim 1, wherein the exhaust valve is connectable with an external inflation connection tube.

* * * * *